US006176594B1

(12) United States Patent
Yarconi

(10) Patent No.: US 6,176,594 B1
(45) Date of Patent: Jan. 23, 2001

(54) STREAMLINED FLUORESCENT LAMP BALLAST AND MOUNTING ASSEMBLY

(75) Inventor: Fred Yarconi, Paramus, NJ (US)

(73) Assignees: Herbert Lagin, Great Neck; Levisohn, Lerner, Berger & Langsam, New York, both of NY (US)

( * ) Notice: Under 35 U.S.C. 154(b), the term of this patent shall be extended for 0 days.

(21) Appl. No.: 09/094,060

(22) Filed: Jun. 9, 1998

(51) Int. Cl.[7] ..... F21V 23/02

(52) U.S. Cl. ..... 362/222; 362/84; 362/260; 362/430; 362/432

(58) Field of Search ..... 362/260, 222, 362/147, 84, 263, 430, 432

(56) References Cited

U.S. PATENT DOCUMENTS 3,733,482 * 5/1973 Miller et al. ..... 240/51.12
4,246,629 * 1/1981 Marrero ..... 362/147
4,809,142 * 2/1989 Auerbach ..... 362/147
5,253,152 * 10/1993 Yung et al. ..... 362/221
5,473,522 * 12/1995 Kriz et al. ..... 362/321
5,676,455 * 10/1997 Johnson et al. ..... 362/301
5,758,952 * 6/1998 Getselis et al. ..... 326/260

* cited by examiner

*Primary Examiner*—Sandra O'Shea
*Assistant Examiner*—John Anthony Ward
(74) *Attorney, Agent, or Firm*—Levisohn, Lerner, Berger & Langsam

(57) ABSTRACT

A low profile fluorescent lamp ballast assembly is provided to allow compliance with the Americans with Disabilities Act. The assembly includes a ballast mounting plate on which the lamp ballast and lamp socket are adjacently mounted, so that the fluorescent bulbs in the socket extend over the lamp ballast. The ballast mounting plate is provided with side flanges for removably securing the lamp ballast and socket assembly to the plate. The lamp ballast may be provided with notches into which side flanges of the ballast mounting plate resiliently project to secure the same. The mounting plate is securable to the electrical junction box, contained within a wall, in a conventional matter.

11 Claims, 5 Drawing Sheets

STREAMLINED FLUORESCENT LAMP BALLAST AND MOUNTING ASSEMBLY

BACKGROUND OF THE INVENTION

1. Field of the Invention

The present invention relates generally to fluorescent lighting. More specifically, the invention relates to a streamlined mounting assembly for securing a fluorescent lighting ballast and socket to any standard junction box.

On Jul. 26, 1990, national legislation was passed banning discrimination against persons with certain disabilities. The legislation, the Americans with Disabilities Act (ADA), relates to a variety of fields, including but not limited to, public services, telecommunications, transportation, and employment.

As a consequence of the ADA, the Architectural and Transportation Barriers Compliance Board published guidelines in order to allow manufacturers and designers of wall sconces, lighting fixtures, water fountains and phone booths to comply with the Act. Generally speaking, such manufacturers must be sensitive to the following: (a) all walkways, corridors and halls must provide at least 80 inches of head room; and (b) all objects mounted between 27 inches and 80 inches from the floor on the walls of hallways must not project more than four inches into the hallway.

There are many types of lighting fixtures available for use in hallways, including incandescent, halogen, fluorescent or recessed ceiling fixtures, sconces, etc. Fluorescent lighting is a preferred means of lighting in heavily trafficked areas where bright, uniform, and efficient illumination is desired, chiefly because fluorescent lighting provides the safest, most economical form of lighting available while providing relatively uniform illumination, all without significant heat.

Since the passage of the ADA, fluorescent lights have traditionally been rejected for such applications as a direct result of their spatial requirements. Even the smallest fluorescent lighting systems require significantly more space than their incandescent or halogen counterparts, in order to accommodate their ballasts and sockets. This general bulkiness has also limited the aesthetic potential for fluorescent lighting systems since applying them to more fashionable fixtures and sconces had traditionally required the re-engineering of the same. Such applications have also required the construction and installation of new junction boxes capable of accommodating the fluorescent light and its bulky ballast and socket assembly.

2. Description of the Related Art

Some manufacturers have unsuccessfully attempted to solve the problem of providing a low profile ADA compliant fluorescent lamp. Although these attempts partially solve the bulkiness dilemma, they fail to provide a sufficiently safe and cost effective solution to the issues raised by the ADA. More particularly, these alternatives have sacrificed safety and quality in their efforts to cut cost and save space. As a direct result of the manufacturers' concentration on price and aesthetics these lighting fixtures may fail to meet the minimum U.L. safety standards.

Some attempts utilize low profile sconces to cure the space concerns raised by the new ADA standards. These sconces function by limiting the space between the bulb and the fixture's shell or casing. Such endeavors have, however, consistently failed to achieve uniform lighting. These failing efforts may be primarily attributed to the fact that when the shell or casing of the sconce is moved closer to the bulb in order to meet the ADA requirements limiting inward projection from walls, a "hot spot" is formed. The hot spot generally results in the fixture's suffering from at least one of two likely unacceptable side effects. First, the primary function of the sconce, aside from its aesthetic qualities, is to diffuse the light uniformly and thus eliminate any chance of hot spots, high intensity area or the like. Second, hot spots are, as the name implies hot, and thus potentially dangerous if contacted, although less so if fluorescent bulbs are used.

Accordingly, it is an object of the invention to provide a low profile ballast mount for fluorescent lights that enables uniform illumination.

It is another object of the invention to provide a ballast mount for fluorescent lights that will comport with the standards of the ADA.

It is another object of the invention to provide a wall sconce for a lighting fixture that does not jut significantly away out from the wall upon which it is mounted. It is a further object of the present invention to provide a simple, cost effective device which can easily convert a standard, electrical junction box to a ballast and socket assembly with a dispersing sconce for an ADA compliant fluorescent lighting device.

SUMMARY OF THE INVENTION

The present invention provides a safe, cost efficient means for providing fashionable fluorescent lighting, keeping all of the above referenced concerns in mind. More particularly, the mounting system and ballast disclosed in the present invention avoids the costly complications associated with the re-engineering, of current lighting systems, or the added expenses of reconstructing walls to include special junction boxes capable of accommodating fluorescent lights conforming with the strict requirements of the ADA.

The above and other objects are achieved by the present invention, which includes a fluorescent light mounting assembly, having a lamp ballast, a socket for the bulb and a ballast mounting plate which secures the lamp ballast and socket to the electrical junction box. The ballast mounting plate includes a bottom flat plate and two upwardly extending side flanges, the side flanges being parallel to one another on the outside surface of the bottom plate i.e., the side facing away from the electrical junction box. The flanges can be provided with inwardly directed locking edges. The side flanges and the bottom flat plate form a channel dimensioned to securely receive the base of a lamp socket and lamp ballast assembly. Longitudinal grooves or notches may preferably be provided in the lamp ballast assembly for engaging the locking edges of the side flanges. The lamp ballast has a first length and the ballast mounting plate has a second length, the second length being greater than the first length so as to form a socket mounting area on the ballast mounting plate adjacent the lamp ballast. The socket mounting area is provided beneath the lamp ballast so that when the base of the lamp ballast and socket assembly is mounted on the socket mounting area, the fluorescent bulbs is secured in the socket extends above the lamp ballast, projecting beyond the length of the lamp ballast.

The present invention also includes a fluorescent lamp wall sconce, having an interior surface, the housing being capable of at least partially transmitting light therethrough and securable to a wall. The sconce fixture is provided with a housing. Disposed inside the housing is a lamp ballast. A ballast mounting plate is fixed to the lamp ballast. The ballast mounting plate includes a bottom plate and two side flanges, the side flanges being disposed parallel to one another on one side of the bottom plate. The side flanges and the bottom plate form a channel dimensioned to securely receive a base of a lamp socket and the lamp ballast. The lamp ballast has a first length, and the ballast mounting plate has a second length, the second length being greater than the first length so as to form a socket mounting area on the ballast mounting plate adjacent the lamp ballast. The socket mounting area is provided behind the lamp ballast so that when the base of the lamp socket is mounted on the socket mounting area, fluorescent bulbs secured in the socket extend above the lamp ballast along the length of the lamp ballast. The housing includes one or more apertures to allow the ballast mounting plate to be secured to a standard, electrical junction box disposed in the wall, so that the ballast mounting plate is flush with the wall.

The invention further includes a method of mounting a fluorescent lamp ballast. A junction box is provided inside a wall so that the upper rim or edge of the junction box is flush with the plane of the wall. A ballast mounting plate, having a bottom plate and side flanges which form a channel for receiving a base of a fluorescent lamp socket and a lamp ballast, is provided. The lamp ballast and the lamp socket are inserted into the channel, and the ballast mounting plate is secured to the junction box.

DETAILED DESCRIPTION OF THE DRAWINGS AND THE PREFERRED EMBODIMENT

Figure 1:
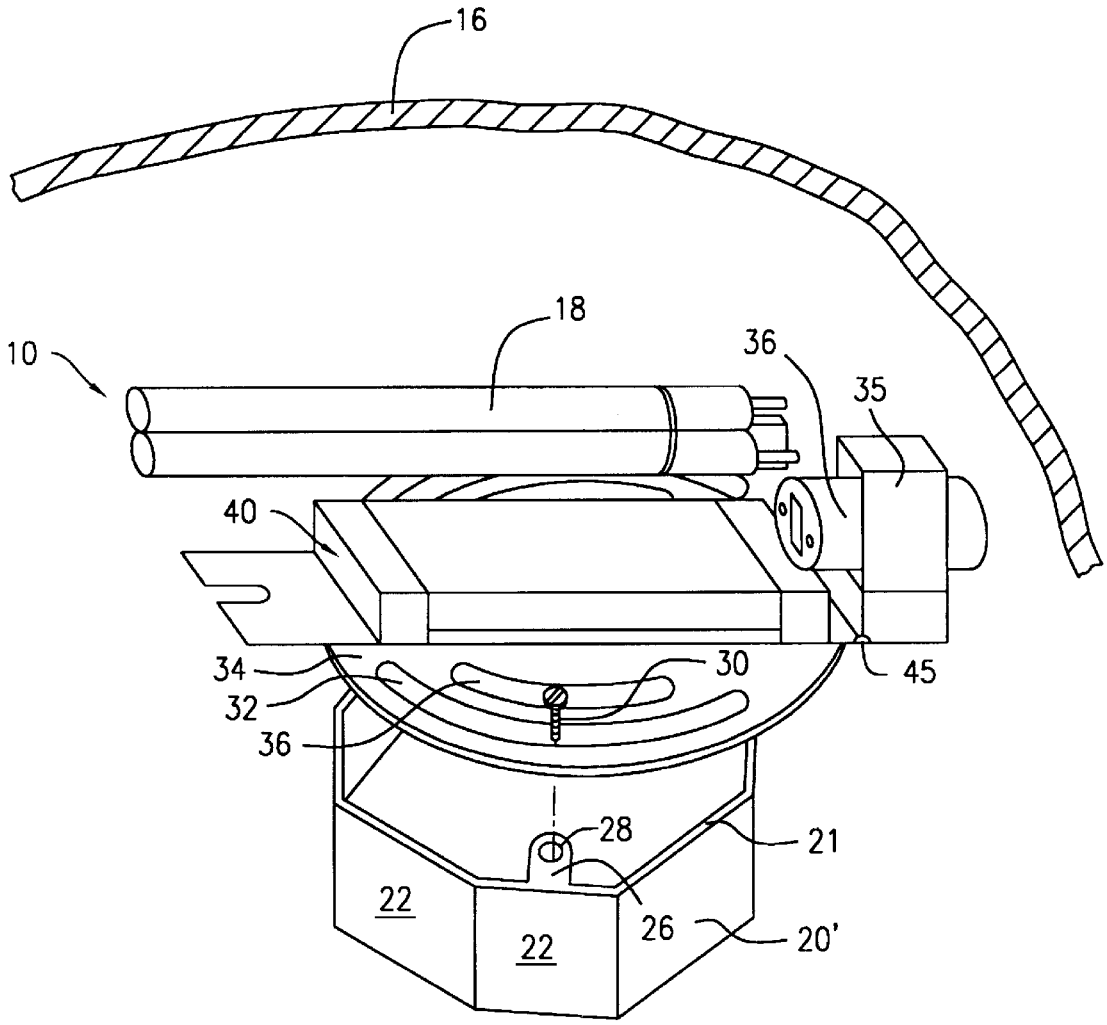
FIG. 1 is a top, perspective and exploded view of a light fixture conforming to the standards of the Americans With Disabilities Act ("ADA") with the ballast mounting plate, P.L. ballast, socket, bulb and dispersing shield according to the present invention.

As best seen in FIG. 1, an ADA-compliant lighting fixture 10 is adapted to be selectively secured and connected to a standard (pre-existing or new installation) electrical junction box 20 while being enclosed by a light-dispensing shield or wall sconce 16 (shown in section). The electrical junction box 20 is secured to a wood cross beam (not shown) in a conventional manner and is recessed into a wall so that its top edge 21 is flush with the sheetrock of the wall. These electrical junction boxes are quite conventional and, yet, the junction box illustrated in the preferred embodiment of the present invention is an octagon with upwardly extending walls 22 forming the sides. An electrical cable (not shown) enters one of the sides 22 (or the rear) of the electrical junction box through a knock-out hole, in a conventional manner, to supply electrical power to the electrical ballast container of the present invention. A pair of inwardly extending ears or lugs 26 (coplanar with the top edge 21), on opposed sides 22 of the electrical junction box, provide threaded apertures 28. These apertures are adapted to receive a screw 30 which first passes through an arcuate-shaped slot 32 of a mounting plate or bracket 34 and then into the aperture 28 of the lug 26 of the electrical junction box 20.

Selectively secured to the mounting bracket or plate 34 is a ballast container 40 which contains the electrical components for receiving the standard electrical power cable from the wall and converting the same into suitable electrical power for electrically driving the fluorescent P.L. tube of the present device. According to the preferred embodiment of the invention, the ballast, in its simplest configuration, consists of a thin profile parallel pipe which is provided on two of its opposite sides with longitudinal notches 42 which receive upwardly and inwardly extending tabs or flanges 50 of the mounting plate 40 (see FIG. 4). The top of the ballast container is provided, on one of its ends, with an upwardly projecting socket mechanism in a convention manner which serves to selectively receive electrical connection of the P.L.-shaped fluorescent bulb.

Ballast container 40 may be fixedly attached to ballast mounting plate or bracket 34 and is positioned underneath the fluorescent bulbs 18 (two sockets can be provided, for two bulbs) thus eliminating the uneven lighting or casting of shadows which occurs when the ballast is orientated in its conventional adjacent configuration. Support housing 35 provides means for both supporting socket 36 and for encasing the wires supplying electricity to socket 36 from ballast 30.

Figure 3A:
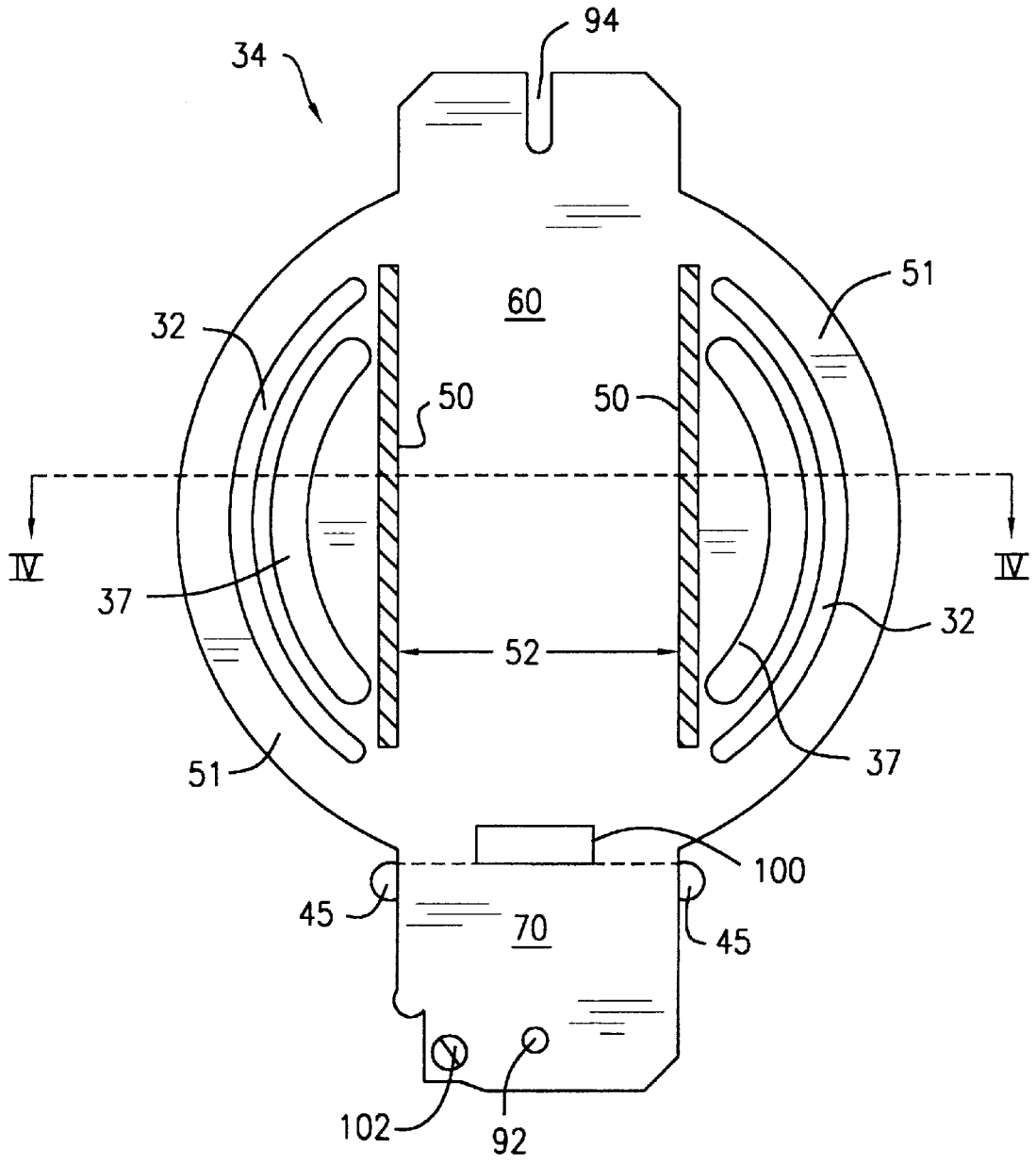
FIG. 3A is a top plan view of the preferred mounting plate or bracket which forms a part of the present invention.

The preferred mounting plate or bracket 34 is best shown in FIG. 3A and is formed from flat sheet metal. It comprises a flat rectangular central portion 60 and a pair of opposed semi-circular regions 51. A pair of inner, arcuate cut-outs 37 are provided to regions 51 as well as a pair of opposed, larger diameter arcuate cut-out segments 32. These arcuate cut-outs allow the mounting plate to be adapted to be received by a variety of junction boxes in a variety of orientations in a manner which is conventional. At least one and preferably at least two screws 30, having heads greater in diameter than the width of the selected arcuate slots, are adapted to be received by the apertures in the inwardly extending lugs or ears of the electrical junction box and, yet, the plate can be rotated to secure it at a desired orientation. Since the head of the screw is larger than the width of the arcuate slots, the mounting plate is firmly secured to the electrical junction box. A center aperture 100 is provided in the mounting plate which allows a pair of electrical leads coming from the ballast container to pass therethrough and be electrically connected, as by suitable electrical connecting twist-ons or other appropriate connecting means including adhesive tape, to the electrical wires coming into the center of the electrical junction box. One wire from the ballast container is connected to a screw 102 which serves as the grounding screw for the device, the grounding screw being secured within a threaded aperture in one corner of the mounting plate.

Figure 2:
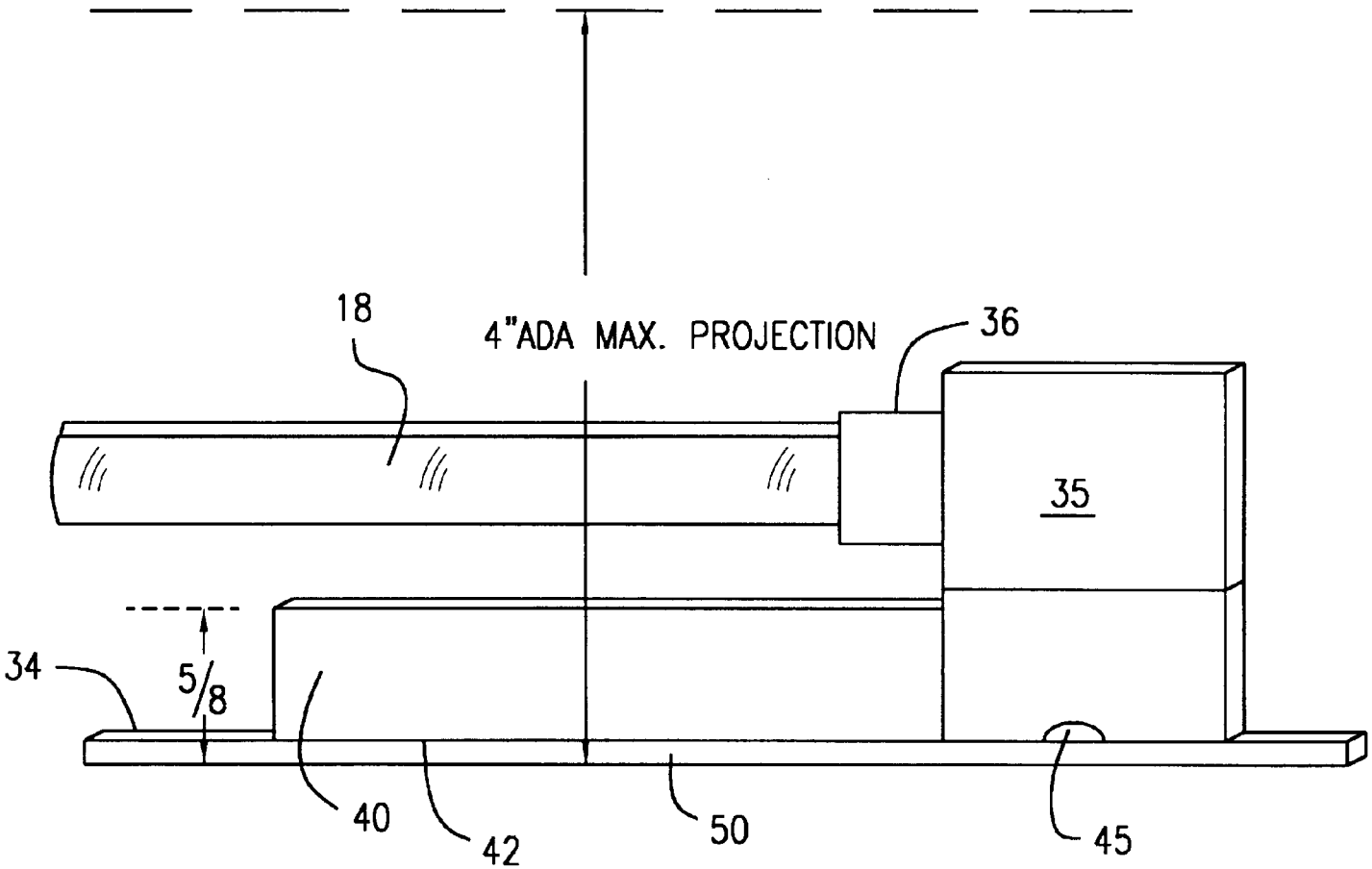
FIG. 2 is a side view of a P.L. ballast/socket assembly showing the P.L. lamp in place and further illustrating the device of the present invention with the ballast container secured to a mounting plate for an electrical junction box.

On the outside face of rectangular area 60, a socket mounting area 70 is provided to which housing means 35 (see FIG. 2) is disposed. Mounting bracket 34 is provided with tabs 45 which may be folded upwardly and/or inwardly over corresponding structure on housing means 35 to secure the housing means 35 to mounting bracket 34.

Figure 4:
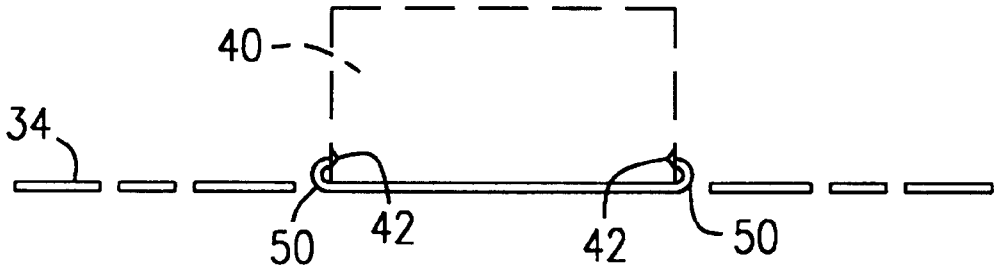
FIG. 4 is a cross-sectional view of the mounting plate, taken along lines 4—4 of FIG. 3A also showing the ballast container (the socket assembly with the fluorescent bulb being not shown for clarity of illustration); and the inter-engagement of the upwardly extending legs of the mounting plate or bracket with a pair of notches in the sidewalls of the ballast container, consistent with the invention.

As can be best seen in FIGS. 3A and 4, the mounting plate is provided with a pair of opposed, upwardly extending, parallel and inwardly directing flanges 50. Each flange 50 runs for a significant distance of the rectangular portion 60 of the mounting plate. Each flange projects upwardly from the surface of the mounting plate and is preferably directed inwardly, and its edge thus forming channel 52 between the flanges. The material of the mounting plate including the upwardly and indirectly flanges is preferably sheet metal and, yet, the flanges have some degree of resilience so that they can be outwardly biased and, yet, they will spring back to their original, upwardly extending, parallel position. This facilitates the selected mounting of the ballast container into and onto the mounting plate and, yet, the ballast container can be selectively removed from the mounting plate, as desired. Toward that end, the base of the ballast container 40 is provided, on both of its sides, with a longitudinal recess or notch 42 which is adapted, by appropriate-configuration to provide a receiving surface for the upwardly and inwardly directed flanges of the mounting plate.

Figure 3B:
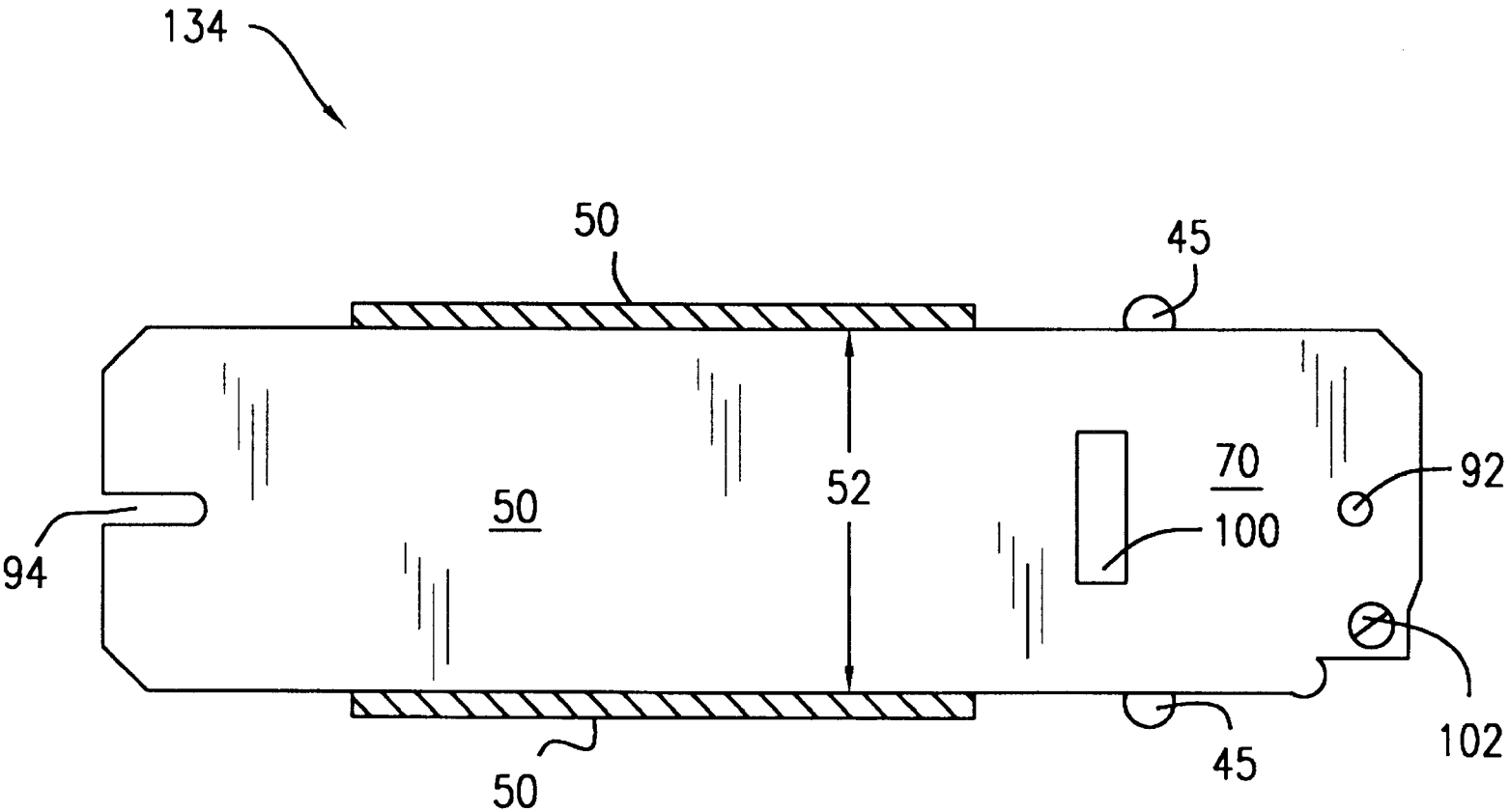
FIG. 3B is a top plan view of an alternate mounting plate or bracket which forms a part of the present invention.

FIG. 3B depicts an alternate form of the mounting bracket. In FIG. 3B, mounting bracket 134 is similar to mounting bracket 34 except that the arcuate side portions, semi-circular regions 51, of mounting bracket 34 are omitted. All other elements of mounting bracket 134 are substantially identical to mounting bracket 24 and have been labelled with like reference numerals; description of these like elements will not be repeated. Since mounting bracket 134 has no side arcuate portions, it may be secured to junction box 20 by screws 30 passing through aperture 92 and/or slot 94, both of which are also provided on mounting bracket 34.

According to the preferred embodiment of the present invention, when an electrician desires to secure the ballast container 40 to the mounting bracket 34, after appropriate wiring connections are accomplished, one side of the ballast container with its longitudinal notch 42 is slid into one of the longitudinally-extending and upwardly directed flanges 50 and, then, with a pushing motion toward the mounting bracket 34, the ballast container 40 is snapped into the other upwardly and inwardly directing flange 50 such that its edge is received within the longitudinal notch 42 of the ballast container 40. To accomplish this, the flanges 50 (or at least one thereof) are resilient so that they can outwardly flex and, yet, they are biased to their original position so that, when the flanges reach the notch of the ballast container, they pop into and secure the ballast container to the mounting bracket.

Alternatively, both notches 42 can be made to engage both flanges 50 simultaneously at one end, and then the ballast container 40 may be slid into place on rectangular portion 60.

In either manner, a very low profile ballast container is secured to an electrical mounting bracket which itself is secured to an electrical junction box. This device, when equipped with an appropriate fluorescent socket (also secured to the ballast mounting bracket) and supplied with a light fixture, fully conforms to the ADA, by placing both the socket and ballast with a low profile. A light difuser 16 is secured over the bulb 18 to diffuse the light and to protect the bulb and electrical components. It can be secured to the assembly in a conventional manner. When installed as described and illuminated, the light conforms to the ADA and provides fluorescent lighting.

What I claim is:

1. A low-profile, ADA-compliant, compact fluorescent light mounting assembly for mounting a compact fluorescent lamp to an electrical junction box on a wall surface, comprising;

a compact lamp ballast and compact bulb socket assembly; and a compact ballast and compact socket mounting plate having a ballast mounting area, said compact ballast and compact socket mounting plate including a bottom surface and a pair of flanges, said flanges being disposed on opposite sides of said ballast mounting area and running substantially perpendicularly along at least part of the length of said ballast mounting area, said flanges extending upwardly from said bottom surface, said flanges and said bottom surface forming a substantially U-shaped channel dimensioned to securely yet movably receive said compact lamp ballast and compact bulb socket assembly, wherein said compact ballast and compact socket mounting plate is directly securable, flush with a wall, to an electrical junction box disposed in the wall.

2. A fluorescent light mounting assembly according to claim 1, wherein said lamp ballast and bulb socket assembly has a first length, and said ballast and socket mounting plate has a second length, said second length being greater than said first length said mounting plate further comprising a ballast and socket mounting area beneath said lamp ballast.

3. A low profile fluorescent light mounting assembly according to claim 1, wherein at least one of said flanges are resiliently secured to said bottom plate.

4. A low profile fluorescent light mounting assembly according to claim 2, wherein said side flanges turn inwardly, above said socket mounting area to engage longitudinal notches in the lamp ballast and bulb socket assembly.

5. A low profile fluorescent light mounting assembly according to claim 2, wherein said ballast and socket mounting plate has one or more foldable tabs, disposed adjacent said socket mounting area to selectively secure a portion of said lamp ballast and bulb socket assembly.

6. A low profile fluorescent light mounting assembly according to claim 2, wherein said assembly is formed by having the base of the bulb socket mounted to said lamp ballast; such that when a fluorescent bulb is secured in the socket it extends above said lamp ballast and along the length of said lamp ballast.

7. A low profile fluorescent light mounting assembly according to claim 1, wherein said lamp ballast and bulb socket assembly includes longitudinal notches formed on opposing sides of said lamp ballast, wherein said flanges engage said notches to secure said lamp ballast and bulb socket assembly to said ballast and socket mounting plate.

8. A low-profile ADA-compliant compact fluorescent lamp fixture, comprising:

a compact lamp ballast and compact socket assembly; and a compact ballast and compact socket mounting plate having a ballast mounting area, directly securable to an electrical junction box in a wall, said compact ballast and compact socket mounting plate including a bottom surface and a pair of parallel, upwardly projecting holding flanges, said holding flanges being disposed on opposite sides of said ballast mounting area and running substantially perpendicularly along at least a part of the length of said ballast mounting area, said holding flanges being resilient and forming a substantially U-shaped channel with said bottom surface dimensioned to securely yet removably receive said compact lamp ballast and compact socket assembly, wherein said compact ballast and compact socket mounting plate is directly securable, flush with a wall, to an electrical junction box disposed in the wall.

9. A low profile fluorescent lamp claimed in claim 8 further comprising a light-dispersing shield.

10. A low profile fluorescent lamp according to claim 8, wherein said lamp ballast and bulb socket assembly has longitudinal notches to receive said flanges.

11. A low profile fluorescent lamp as claimed in claim 9 wherein the distance between the exterior of said light-dispensing shield and said mounting plate does not exceed four inches.

* * * * *

UNITED STATES PATENT AND TRADEMARK OFFICE

CERTIFICATE OF CORRECTION

PATENT NO. : 6,176,594 B1
DATED : January 23, 2001
INVENTOR(S) : Fred Yarconi

It is certified that error appears in the above-identified patent and that said Letters Patent is hereby corrected as shown below:

Title page,
Item [75], please correct the inventor's name to read as follows: -- Fred Yarkoni --

Item [19], should read as follows: -- Yarkoni --

Signed and Sealed this

Second Day of October, 2001

*Attest:*

Nicholas P. Godici

NICHOLAS P. GODICI
*Acting Director of the United States Patent and Trademark Office*

*Attesting Officer*